US005588889A

United States Patent [19]

Easter

[11] Patent Number: 5,588,889

[45] Date of Patent: Dec. 31, 1996

[54] TIMING BUOY WITH REMOTE TIMING CAPABILITY

[76] Inventor: Scott D. Easter, 322 N. Birchwood, Hendersonville, Tenn. 37075

[21] Appl. No.: 512,121

[22] Filed: Aug. 7, 1995

Related U.S. Application Data

[63] Continuation-in-part of Ser. No. 432,572, May 1, 1995.

[51] Int. Cl.[6] ..... B63B 22/18

[52] U.S. Cl. ..... 441/1; 441/26; 441/32

[58] Field of Search ..... 441/1, 6, 21, 23, 441/26, 28, 32, 25, 2; 116/107; 368/1, 6, 10; 114/328

[56] References Cited

U.S. PATENT DOCUMENTS

| | | | |
|---|---|---|---|
| 2,619,170 | 11/1952 | Rath | 368/1 |
| 3,628,205 | 12/1971 | Starkey et al. | 441/25 |
| 4,077,076 | 3/1978 | Masters | 116/107 |
| 4,392,122 | 7/1983 | Hocken | 340/323 R |
| 4,652,141 | 3/1987 | Arai | 368/10 |
| 4,657,403 | 4/1987 | Morgan et al. | 368/6 |
| 4,731,766 | 3/1988 | Bunyea | 368/10 |
| 5,016,227 | 5/1991 | Turner, Jr. | 367/3 |
| 5,276,660 | 1/1994 | Lee | 368/10 |

*Primary Examiner*—Sherman Basinger
*Attorney, Agent, or Firm*—Rick R. Wascher

[57] ABSTRACT

A timing buoy comprising a flotation buoy having an outer shell. A switch in communication with the outer shell and activatable in response to forcible contacts to the shell. A timing device responsive to the switch to start and stop a timing sequence in response to a forcible contact to the shell of the buoy. An embodiment of the invention may also include a transmitter and receiver to start and stop a remote timing device in response to contacts on the shell of the buoy which actuate the switch. The invention may also include a method for timing a watercraft event by positioning the inventive apparatus in the path of the watercraft and enabling the watercraft to strike the buoy to start and stop the timing sequence of the timing device.

19 Claims, 8 Drawing Sheets

STOPWATCH RECEIVER DIAGRAM

SWITCH TRANSMITTER DIAGRAM

TIMING BUOY WITH REMOTE TIMING CAPABILITY

This is a continuation-at-part of copending application Ser. No. 08/432,572 filed on May 1, 1995.

BACKGROUND OF THE INVENTION

1. Field of the Invention

The present invention relates generally to aquatic buoys and stop watches, but more particularly to aquatic buoys including timing components such as a stop watch.

2. Description of the Related Art

The art to which the invention relates includes aquatic buoys used to mark shipping and boating lanes or restricted areas in bodies of water. Such buoys are often used in water sports such as boating events where a boat or motorized watercraft travels a predetermined course which is defined by a series of buoys. It is often difficult to determine the time a watercraft completes a course and such timing components may be simply associated with photoelectric eyes which enable the watercraft to start and stop as they pass a photoelectric eye at the start/stop finish line.

Thus, the buoys partially comprising the art to which the invention relates include a floating bulb or buoy component to which an anchor line an anchor is attached. The anchor line and anchor serve to hold the buoy in a predetermined location and prevent movement and thus alteration of the course during a watercraft racing event.

The art to which the invention relates also includes timing devices such as stop watches and those capable of being started and stopped to record the time elapsed during a specific event. Such timing devices are common in racing sports, particularly those that time the driver of the motorcraft to complete a specified course. Such devices are often connected to photoelectric eyes that emit an invisible beam which is broken when the motorcraft (or watercraft) passes through the beam. Passing through the beam therefore starts and stops the timing component of the timer.

During a watercraft race, game, or other timed event involving lap or split times, it is important for the race judges and competitors to accurately determine the time it takes for each racer to complete all or a portion of the course. The inability to accurately determine the split or lap times associated with the watercraft driver's completion of a portion of the course is even more common in informal racing events between individuals who simply enjoy watercraft sports, but require a means to time their performance over a predetermined course.

In the past, the aforementioned timers must be positioned not only at the start/stop line but also must be coordinated in conjunction with a portion of the course in order to provide progressive information as to how the driver of the watercraft is doing in comparison to previously established times or posting a benchmark time. Thus, in order to outfit the race course with photoelectric timing devices can be expensive and somewhat complicated, and not practical for informal events between individuals. Furthermore, other than the practical desire to run a tight course, when recording split or lap times there is nothing to require a watercraft driver to maintain a tight course and turn the corners as quickly as possible during an event.

Accordingly, it would be advantageous to invent a timing buoy which is capable of starting and stopping when contacted by a watercraft. Such a device could have a delay such that repetitive start and stop signals normally associated with the contact of a the buoy shell must be spaced apart in time by a predetermined interval in order to avoid false starts and stops. The repetitive delay component of such a timing buoy would allow the timing device to be started and stopped only after the time interval has elapsed. In this way, if the buoy were allowed to bounce beneath the craft as the craft strikes and rides over the buoy, the first contact would either start or stop the timer depending upon the sequence of contacts, allow for false starts and stops.

SUMMARY OF THE INVENTION

An embodiment of the present invention is directed to a timing buoy capable of being attached to an anchor line for accurate controlled positioning of the buoy in a body of water. An embodiment of the present invention includes a shell capable of receiving and responding to the impact associated with a watercraft striking the buoy. The preferred embodiment also includes a switch operably attached to the shell of the buoy such that when the watercraft strikes the buoy the switch is activated to either start or stop the watch depending upon the sequence in which the buoy was initially struck.

In one embodiment of the present invention, the timing buoy includes a lower component and an upper component operably connected to one another. The shell is the surface of the buoy formed by the upper and lower components and is part of the individual components. A toggle type switch is interpositioned between the upper and lower components. In this fashion, when the upper component or lower component is struck, the switch interpositioned therebetween is toggled to initiate, or stop the timing sequence of the timing device. The timing device, therefore, is operably electrically connected to the switch in that it receives a signal to start and stop the timing sequence in response to contacts made to the shell of the buoy.

The buoy of the preferred embodiment also includes a tie down loop to which an anchor rope may be attached. In addition, the base component may also include a well for receiving the upright stem of an anchor as well as the anchor rope so that the entire unit may be self-contained. In this fashion, the anchor rope is wound about a spool positioned within the lower component and the upright stem of the anchor is inserted into the anchor stem receiving well of the lower component.

The upper component is placed over the anchor receiving well with the timing switch interpositioned therebetween. An airspace is preferably provided between the upper and lower components to enable the timing switch to toggle. Of course, other suitable switches may be used. For example, contact switches that are simply depressed for on and off sequencing may be incorporated, as well as pressure switches such that when the shell of the buoy is contacted a change in interior pressure of the shell would cause the switch to activate and therefore start or stop the timing element of the invention.

Accordingly, the present invention may be constructed of a single component or of an upper and lower component so long as an outer shell is provided to receive the contact from the watercraft. In response to the contact, a switch is placed in operative communication with the shell in order to transmit the contact via the switch to a timing element to start and stop the timer.

The present invention is also directed to a method of timing a watercraft race by positioning at least one buoy constructed in accordance with the apparatus of the present invention along the race course such that the watercraft pilot must contact at least one timing buoy constructed in accordance with the present invention to either start or stop the timer.

Of course, it is contemplated to connect all timers in series such that multiple timers used throughout a race course may be started at the same time and shut off sequentially as the pilot of the watercraft strikes each buoy consecutively along the course. In this fashion, the method may also include the method of posting times during a race.

Accordingly, the present invention may be summarized in a variety of ways, one of which is the following: a timing buoy, comprising: a shell; a timing device; a switch operably attached to the shell enabling the switch to be actuated in response to contact forces applied to the shell; and connection means for connecting the switch to the timing device to transmit the a start and stop signal to the timing device in response to actuation of the switch.

The shell of the timing buoy may further include first and second shell portions, an anchor line eyelet attached to the shell, and an internal well for storing of an anchor.

The switch or switch means may further include, for example, a toggle shaft or a shaft and a boot slidably attached to the shaft.

The invention may also be summarized as follows: a timer for watercraft sports, comprising: a buoy having outer shell; a timing device attached to the buoy; and switch means in communication with the shell and responsive to contact forces on the shell for transmitting an electrical signal to the timing device to actuate a timing sequence in response to contact forces applied to the shell.

In addition, the invention may be summarized as follows: a timer for watercraft sports, comprising: a shell; a timing device attached to the shell; and switch means in communication with the shell and responsive to contact forces on the shell for transmitting an electrical signal to the timing device to actuate a timing sequence in response to contact forces applied to the shell; and connection means for connecting the switch means to the timing device to transmit an electrical signal to the timing device in response to a contact force applied to the shell in order to start and stop the timer.

The invention may also include a transmitter and a receiver as part of the electrical connection or connection means in order that a signal may be transmitted in response to an actuation of the float switch, and a receiver is provided to receive the start/stop signal to begin or cease the timing function of the invention. The signal to start and/or stop the timing device may be transmitted or received at locations remote to the buoy or watercraft.

It is an object of the present invention to provide a buoy having a timer.

It is an object of the present invention to provide a buoy having a timer which may be started and stopped in response to contact of the shell of the buoy.

It is an object of the present invention to provide a timing buoy having an upper component and a lower component with a toggle switch or other suitable start/stop switch interpositioned therebetween.

It is an object of the present invention to provide a buoy with a timing device capable of being started and stopped in response to contact by, for example, a watercraft.

It is an object of the present invention to provide a buoy having a timing apparatus which is useful along a race course used by watercraft.

It is an object of the present invention to provide a system for timing a watercraft race.

It is an object of the present invention to provide a timing device useful with watercraft and having the capability to remotely send and receive a signal to start and or stop the operation of a timing device.

It is an object of the present invention to provide a timing buoy having a timing device capable of being started and stopped in response to contact to the outer shell of the buoy and having means to which an anchor rope and anchor may be attached.

It is an object of the present invention to provide a timing buoy having a timing device capable of being started and stopped in response to contact to the outer shell of the buoy and having means to which an anchor rope and anchor may be attached as well as installed and contained therein for easy portability.

The invention may also include a method for timing a watercraft event by positioning the inventive apparatus in the path of the watercraft and enabling the watercraft to strike the buoy to start and stop the timing sequence of the timing device.

These and other objects, features, and advantages of the present invention shall become apparent after consideration of the specification and drawings set forth herein and all such objects, features and advantages are believed to comprise the present invention even though not specifically set forth.

DETAILED DESCRIPTION OF THE PREFERRED EMBODIMENT(S)

Figure 1:
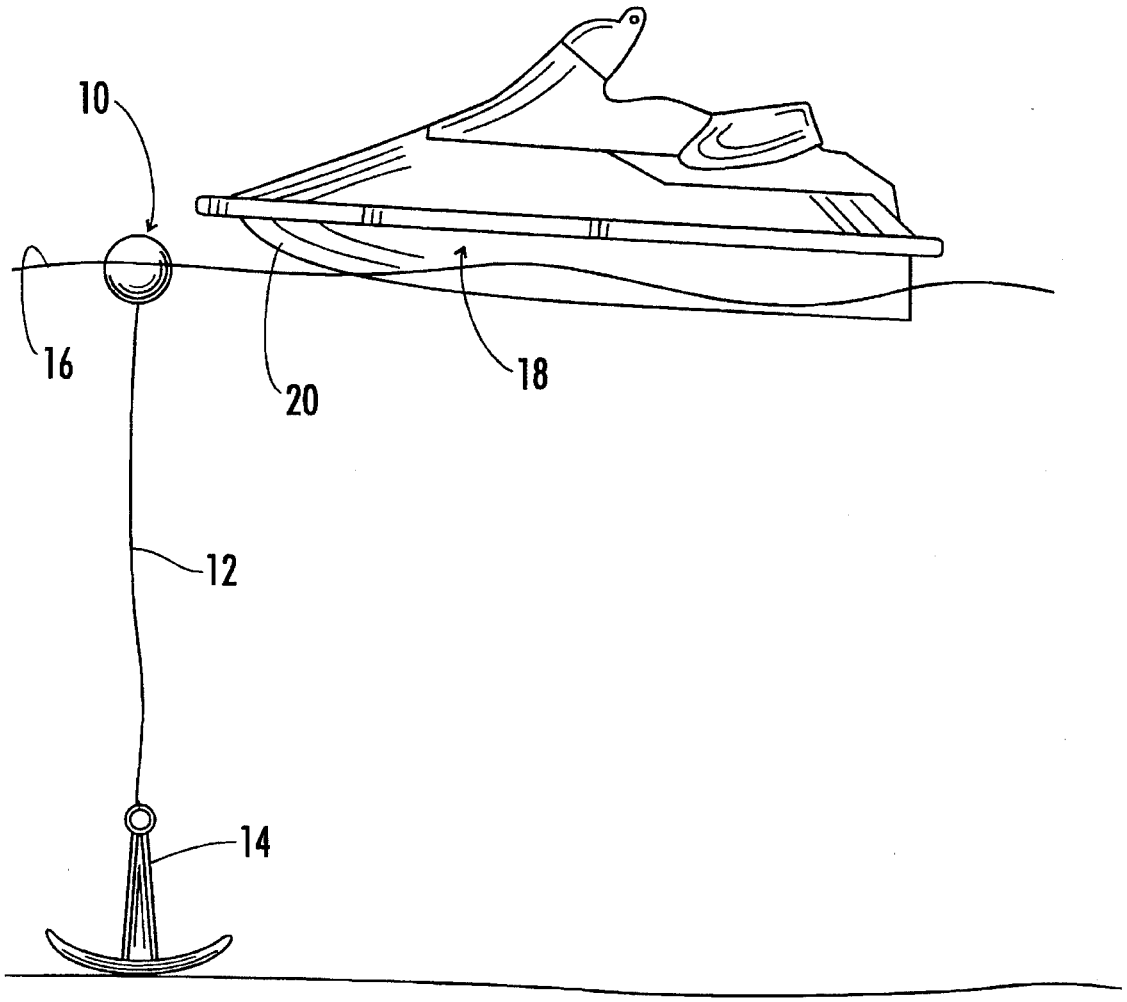
FIG. 1 is a representational perspective view of an embodiment of the present invention shown in relation to the surface of the water on which a watercraft may be operated.

With reference to FIG. 1, an embodiment of the present invention is designated generally by the reference numeral 10. Embodiment 10 is held in place by an anchor line 12 having an anchor 14 attached thereto.

The buoy 10 floats on the surface of the water 16 on which a watercraft 18 rests. The bow of the watercraft 20 is positioned adjacent the buoy and is shown in representative scale, but it is not limiting in such scale, such that the bow 20 may contact the buoy 10 should the watercraft 18 move in a forward direction.

Figure 2:
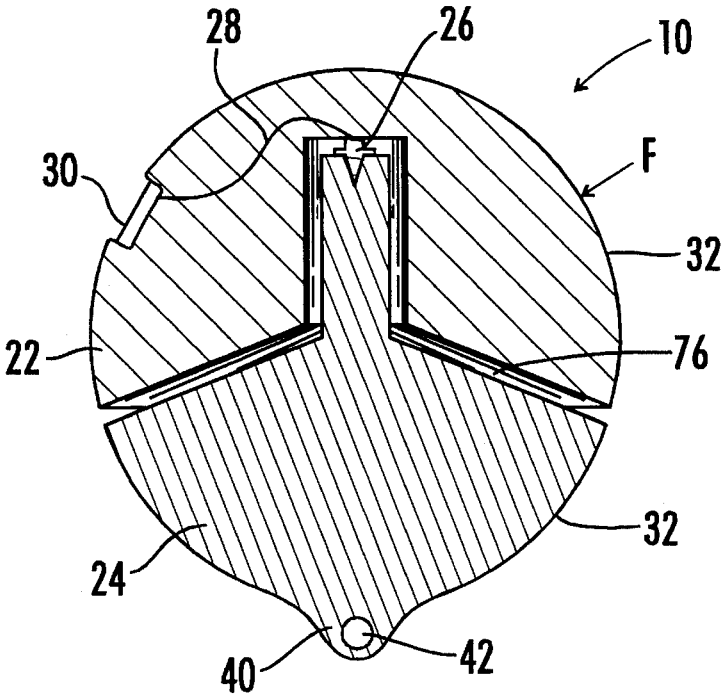
FIG. 2 is a partial cross sectional view of an embodiment of the present invention incorporating upper and lower components.
Figure 3:
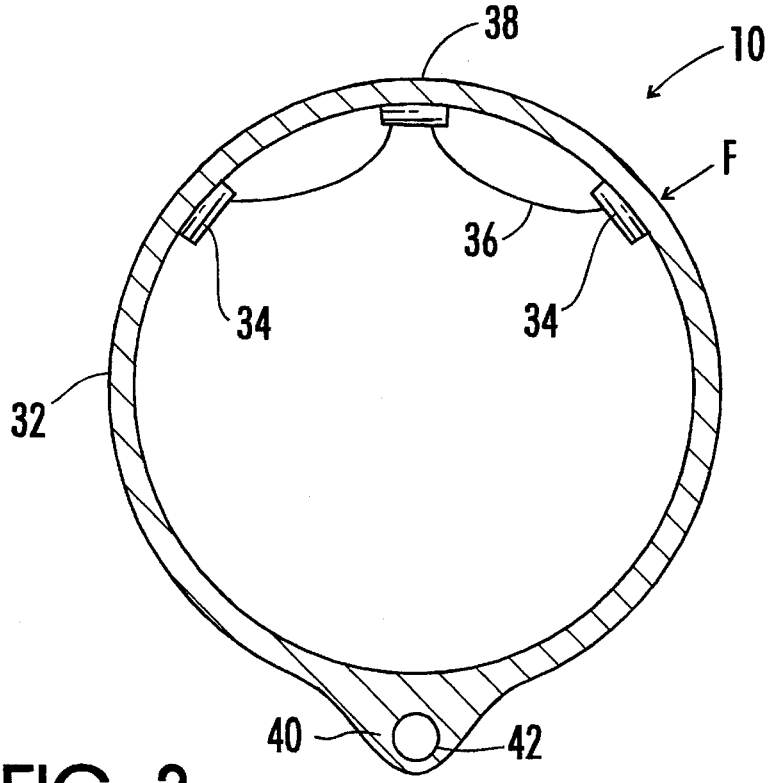
FIG. 3 is an alternate embodiment of the present invention shown in FIG. 2 but constructed of a single component.

With reference to FIGS. 2 and 3, an embodiment of the present invention 10 is shown as a dual construction (FIG. 2) and a unitary construction (FIG. 3). With reference to FIG. 2, the dual construction, an upper component 22 is operably attached to a lower component 24. A switch 26 is interpositioned therebetween. In the preferred embodiment, a variety of switches may be used, such as an Arco electric 700 series joystick type switch manufactured by Arco Electric Corporation of Canoga Park, Calif.

Operably attached to the switch 26 is an electrical lead 28 which terminates in a timing component 30. Optional lens 31 shield the timing device 30 from forcible contact. If, for example, a force F is applied to the upper component 22, it causes the joystick switch 26 to toggle and send a start/stop signal through the electrical connection 28 to the timing device 30.

When the electric signal is received by the timing device 30, it either stops or starts the timer depending upon the sequence of the contact in relation to a running or a stopped timer. In the preferred embodiment of the timer, a start signal may also include a reset feature such that a new start resets the time to zero before beginning a subsequent timing event.

Similarly, with reference to FIG. 3, if a force F is applied to the outer shell 32 (like that shown in FIG. 2), a pressure contact switch 34 is actuated. Actuation of the switch sends a signal via electrical connection 36 to the timing device 38. The timing device in either embodiment, shown in FIG. 2 or 3, may be of any suitable configuration, but a typical stop watch may be employed.

An optional tie-down eyelet 40 is provided as having an aperture 42 through which an anchor line may be attached (see FIG. 1 ).

Figure 4:
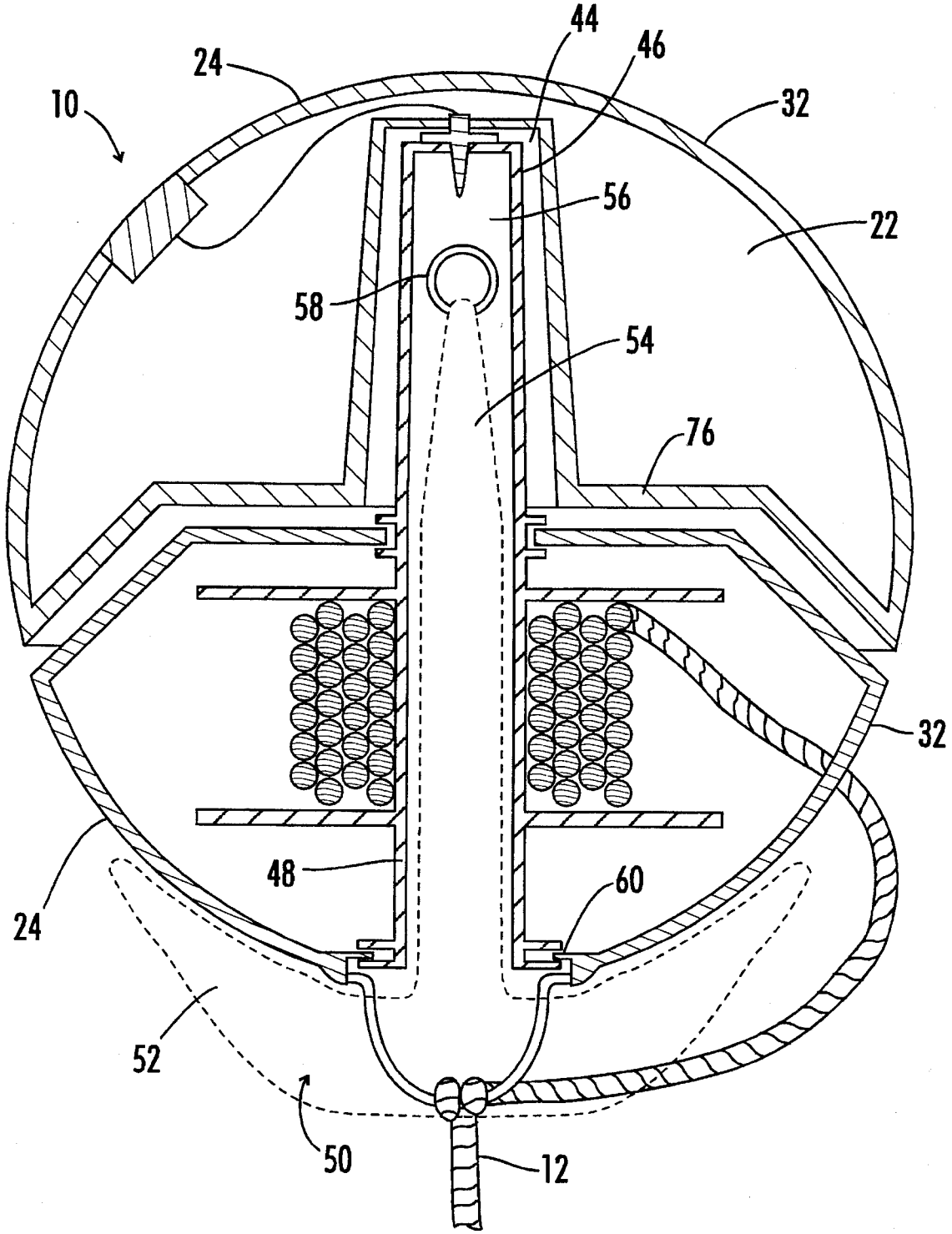
FIG. 4 is a cross sectional view of an alternate embodiment of the apparatus of the present invention shown in FIG. 2.

With reference to FIG. 4, an alternate embodiment of the present invention shown in FIG. 2 is shown in an enlarged cross sectional view. Shell 32 is associated with the exterior surface of the buoy 10. Upper component 22 comprises an interior well 44 to receive the spool 46 which is contained within the lower component 24. The spool 46 therefore enables the anchor line 12 to be wound around the central shaft 48 of the spool. In addition, anchor 50, shown in dashed lines, includes a ground engaging portion 52 and an upward shaft portion 54. The upwardly projecting shaft 54 is received within the compartment 56 of the spool 46.

In addition, the optional anchor may include an anchor line ring 58 to which the anchor line 12 may be attached. In this fashion, the anchor line is secured to the buoy by virtue of the spool's component relationship with the lower portion and held in place by the tongue and groove cooperating structure 60 and also attached to the ring 50 of the anchor shaft 54.

Figure 5:
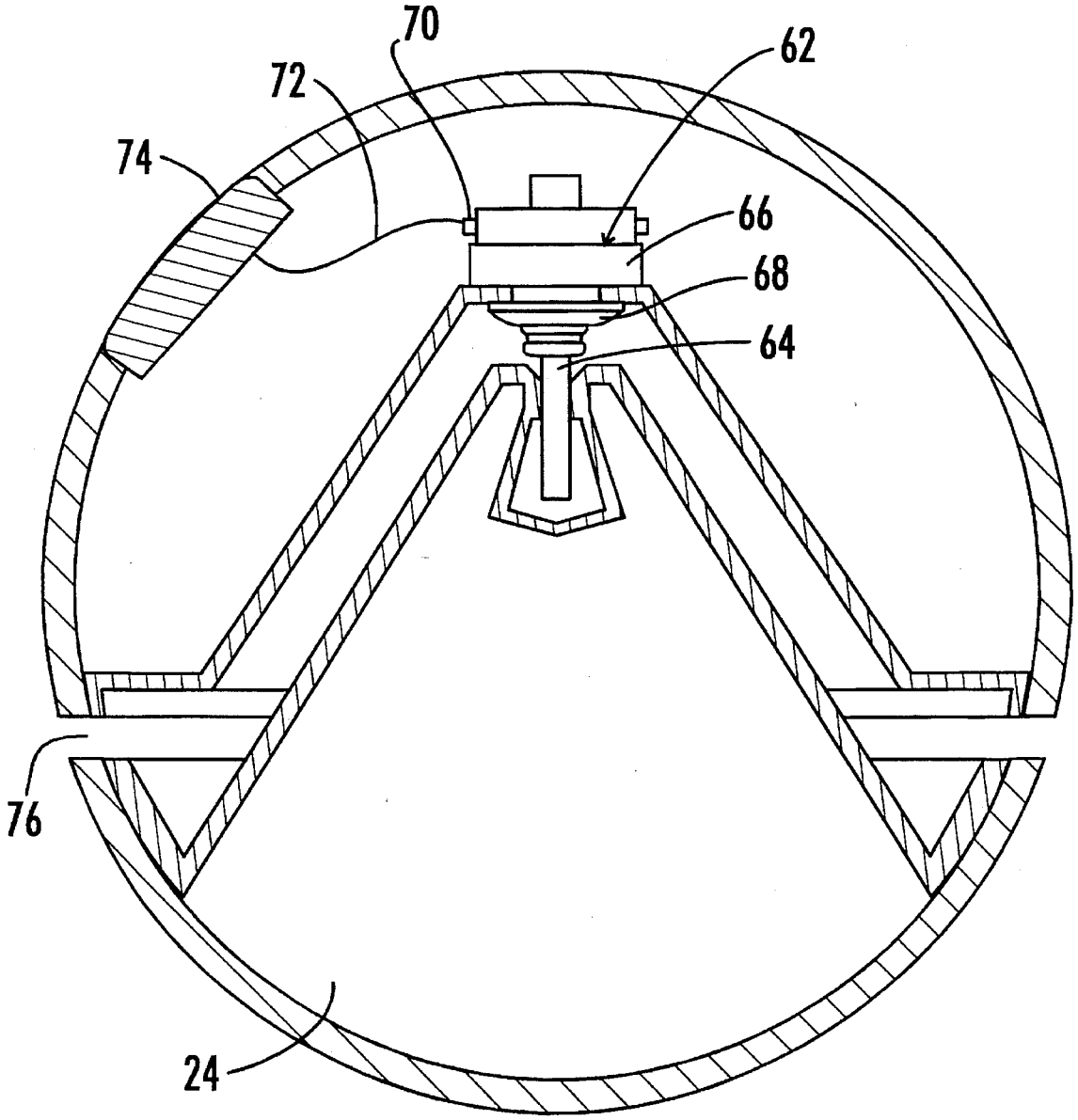
FIG. 5 is a cross sectional view of an alternate embodiment of the present invention shown in FIG. 4.

With reference to FIGS. 2, 4 and 5, space 76 is provided between the upper component 22 and lower component 24. In the two-piece embodiment, this space is provided to enable the top component 22 to toggle with respect to the lower component and therefore actuate the switch. In addition, this allows for easy servicing of the switch should it be necessary, simply by removing the upper component from the lower component.

Figure 6:
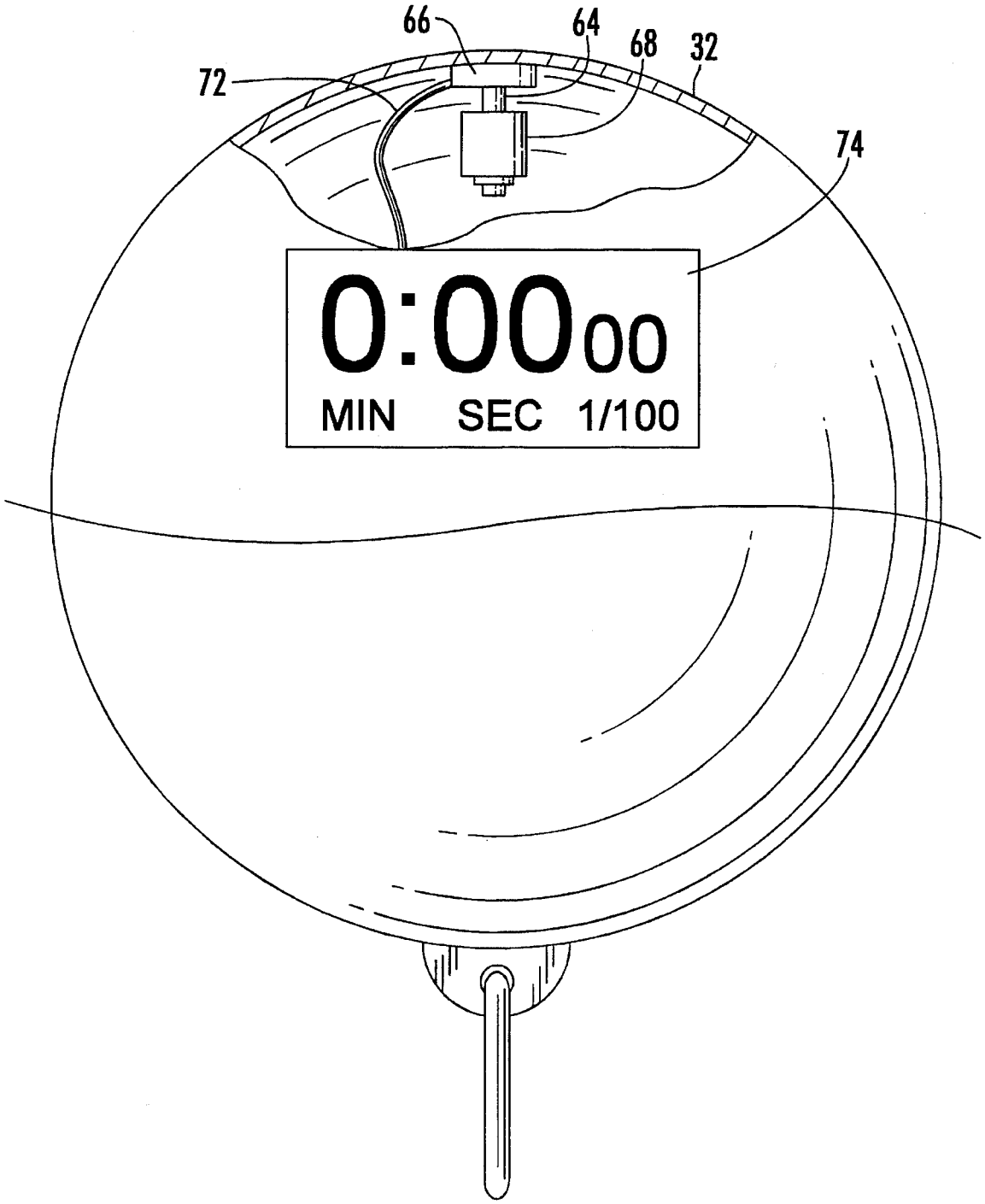
FIG. 6 is a partial cross sectional view of an alternate embodiment of the present invention shown with a time recording element attached thereto.
Figure 7:
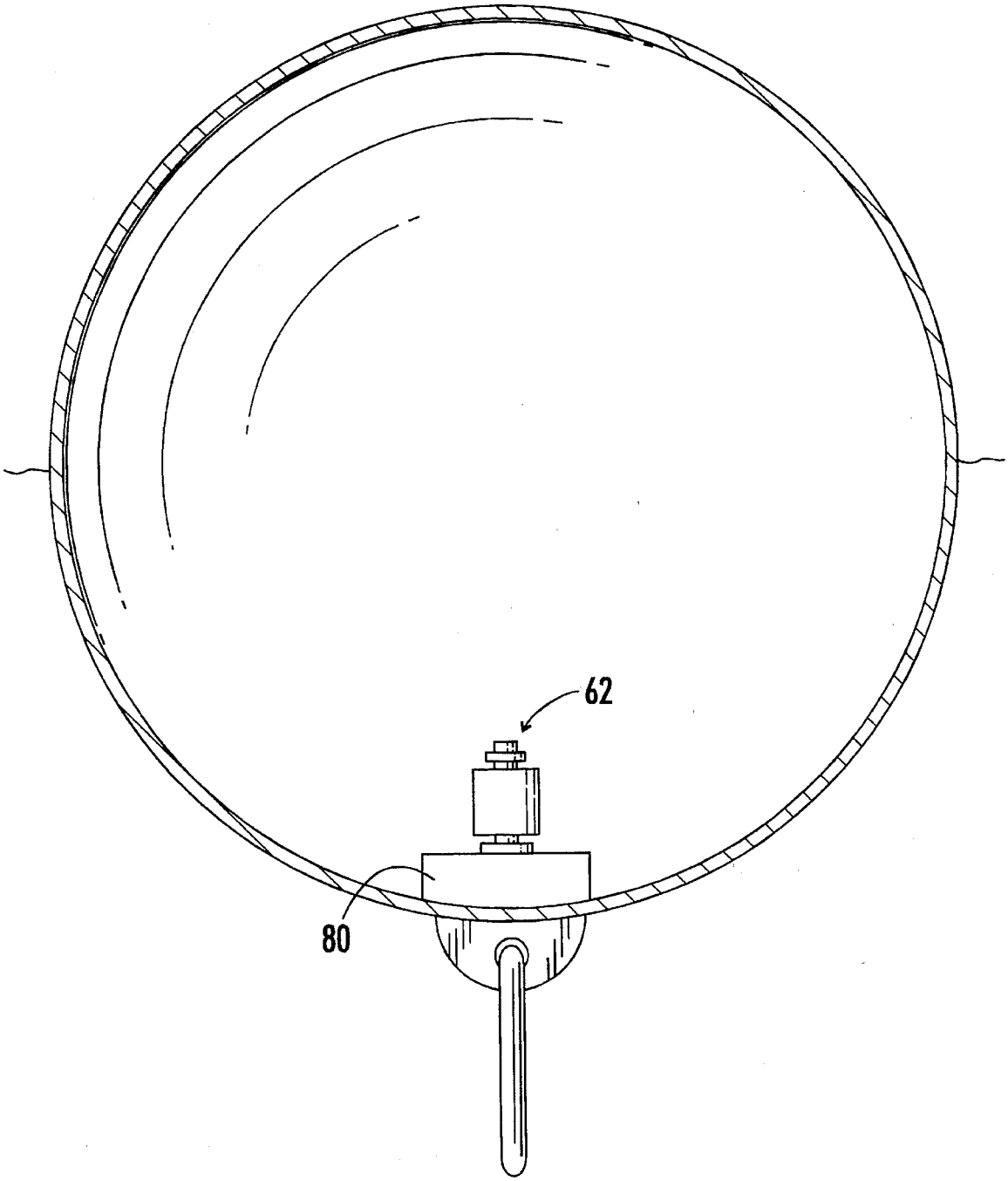
FIG. 7 is a cross sectional view of an alternate embodiment of the present invention shown in FIG. 6 with the time recording element removed.

With reference to FIGS. 5–7, the float switch 62 incorporates a shaft 64 attached to the switching housing 66 and is covered by a boot 68 to prevent debris, water, and other material from entering the switching housing 66. In this fashion, the shaft 64 is received by the lower component 24 of FIG. 5 or the shell 32 of FIG. 6. Electrical port 70 is attached to the housing 66 through which electrical leads 72 may extend (FIG. 5). The electrical leads 72 are then attached to the timing mechanism 74 in an operable relationship.

When the embodiments of FIGS. 6 and 7 are used, if the shell 32 is forcibly struck, the buoy recoils causing the boot 68 to slide along the shaft 64 triggering the timing device 74 (FIG. 6 and FIG. 8) to start or stop timing. Float switch 62 may be of any suitable configuration, including but not limited to, a "miniature polypropylene float and stem" as sold by McMaster-Carr on page 1557 of their products catalog. The maximum pressure of the McMaster-Carr float switch 62 is 50 psi which is less than the internal pressure of the buoy body, and the maximum operating temperature of the float switch is 221 degrees fahrenheit.

With reference to the aforementioned McMaster-Carr catalog page 1557, an embodiment of the float switch is a conventional reed-style liquid level control switch, wherein a hermetically sealed reed switch is activated by a permanent magnet in the float portion.

An embodiment of the preferred timing mechanism is the working components of a model 221 stopwatch manufactured by Sportline of Campbell, Calif. An embodiment of the preferred transmitter and receiver is the working components of a wireless remote door chime sold by RADIO SHACK and having catalog number 63-871. The wireless remote door chime utilizes a wireless transmission from the transmitter to the receiver.

Figure 8:
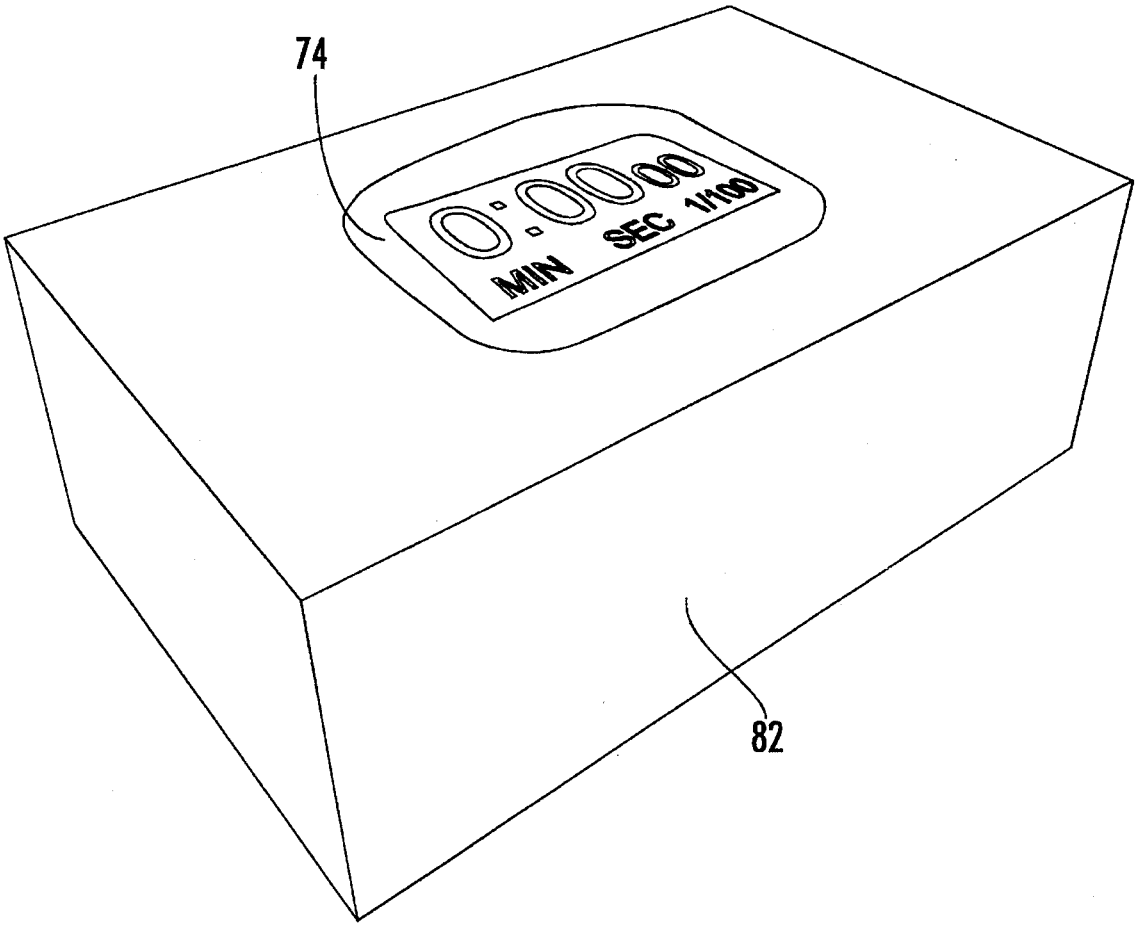
FIG. 8 is a representational perspective view of a receiver box with a timer which may be mounted to the dash or any portion of a watercraft.
Figure 9A:
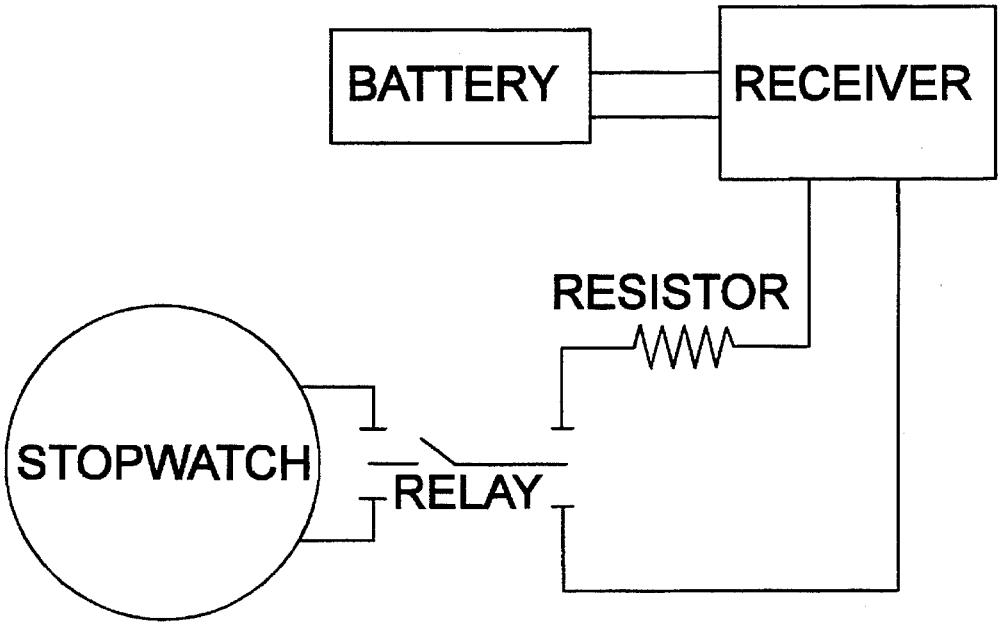
FIGS. 9A and 9B are schematic diagrams of the receiver circuit and transmitter circuit respectively of the present invention.
Figure 9B:
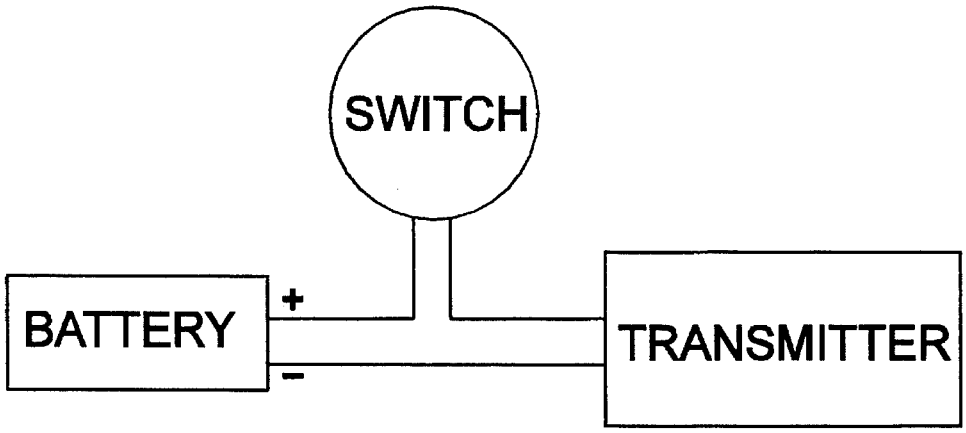

Thus, with reference to FIGS. 8, 9A and 9B, considered with respect to any of the embodiments or equivalents of the embodiments of the invention, the invention also includes a remote timing device 74. The remote embodiments of the invention may therefore, include a timing device 74 attached to the watercraft or a timing board as commonly associated with racing events.

In use, activation of the float switch 62 in the manner described above triggers the transmitter 80 to send an electrical signal to the timing device 74 which may be configured to include the receiver components within the housing 82, wherever it is located, in order to begin the start or stop of the timing device.

Hence, multiple timing devices may be setup on various relays in order that a racer triggering the various timing circuits can post split times as portions of the racecourse is completed. An embodiment of the preferred transmitter and receiver circuitry is illustrated in FIGS. 9A and 9B.

Of course, all of the components of the present invention are waterproofed. In fact, boot 68 may provide additional means of water resistance for the timing mechanism housing 66 and the shaft 64 as it may optionally have a tight sealing engagement therebetween.

These and other embodiments of the present invention shall become apparent after consideration of the specification and drawings provided for and set forth herein, but whose only limitation is the scope of the appended claims attached hereto.

What is claimed is:

1. A timing buoy for watercraft sports, comprising:

a shell configured to operably receive and operably withstand contact forces;

a timing device;

a switch operably attached to the shell enabling the switch to be actuated in response to contact forces applied to the shell;

connection means for transmitting an actuation signal from the switch to a transmitter in response to a contact force applied to the shell; and wherein the transmitter is configured to send a signal to a remote receiver enabling the receiver to actuate the timing device in order to operably start or stop the timing device in response to a contact force applied to the shell.

2. The timing buoy of claim 1, wherein the shell further includes:

first and second shell portions.

3. The timing buoy of claim 1, further including:

an anchor line eyelet attached to the shell.

4. The timing buoy of claim 1, further including:

an internal well for storing of an anchor.

5. The timing buoy of claim 1, wherein the switch further includes:

a toggle switch.

6. The timing buoy of claim 1, wherein the switch further includes:

a shaft and a boot slidably attached to the shaft.

7. The timing buoy of claim 1, such that the transmitter and receiver further include:

means for transmitting and receiving a wireless signal, respectively.

8. A timer device for watercraft sports, comprising:

a buoy having outer shell;

a timing device; and switch means in communication with the shell and operably responsive to contact forces on the shell for sending an electrical signal to a transmitter and a remote receiver combination such that the transmitter is configured to send a wireless signal to the receiver in response to an electrical signal from the switch means in response to contact forces applied to the shell and the wireless signal from the transmitter is received by the receiver which actuates the timing device to actuate a timing sequence in response to contact forces applied to the shell and the wireless signal from the transmitter.

9. The timer of claim 8, wherein the buoy further includes:

an upper portion and a lower portion.

10. The timer of claim 8, further including:

an anchor line eyelet attached to the shell.

11. The timer of claim 8, further including:

an internal well for storing of an anchor.

12. The timer of claim 8, wherein the switch means further includes:

a toggle switch.

13. The timer of claim 8, wherein the switch means further includes:

a shaft and a boot slidably attached to the shaft.

14. A timer for watercraft sports, comprising:

a shell;

a timing device; and switch means in communication with the shell and responsive to contact forces on the shell for transmitting an electrical signal to the timing device to actuate a timing sequence in response to contact forces applied to the shell; and connection means for electrically connecting the switch means to the timing device to transmit an electrical signal to the timing device in response to a contact force applied to the shell in order to start and stop the timing device;

wherein the connection means further includes transmitter circuitry and the timing device further includes receiver circuitry in order that an electrical signal may be transmitted and received by the timing device;

wherein the transmitter circuitry and receiver circuitry combination are wireless one with respect to the other such that a wireless signal from the transmitter is received by the receiver without the need for an electrical connections therebetween.

15. The timer of claim 14, wherein the shell further includes:

first and second shell portions.

16. The timer of claim 14, further including:

an anchor line eyelet attached to the shell.

17. The timer of claim 14, further including:

an internal well for storing an anchor.

18. The timer of claim 14, wherein the switch means further includes:

a toggle switch.

19. The timer of claim 14, wherein the switch means further includes:

a shaft and a boot slidably attached to the shaft.

* * * * *